US008087281B2

(12) United States Patent
Balazsi et al.

(10) Patent No.: US 8,087,281 B2
(45) Date of Patent: Jan. 3, 2012

(54) METHOD TO CONTINUOUSLY FORM SURFACE MOUNT FLANGED PINS

(75) Inventors: James W. Balazsi, Milford, CT (US); Kraig R. Rayl, Logansport, IN (US)

(73) Assignees: Bead Industries, Inc., Milford, CT (US); Total Electronics LLC, Logansport, IN (US)

( * ) Notice: Subject to any disclaimer, the term of this patent is extended or adjusted under 35 U.S.C. 154(b) by 749 days.

(21) Appl. No.: 12/186,561

(22) Filed: Aug. 6, 2008

(65) Prior Publication Data

US 2010/0031728 A1 Feb. 11, 2010

(51) Int. Cl.
*B21J 11/00* (2006.01)

(52) U.S. Cl. ..... 72/404; 72/294; 470/34; 470/122; 470/125; 470/137; 470/141

(58) Field of Classification Search ..... 72/306, 72/307, 404, 405.01, 294; 470/8, 11, 12, 470/57, 121, 122, 123, 124, 125, 137, 141, 470/154, 27, 34, 40
See application file for complete search history.

(56) References Cited

U.S. PATENT DOCUMENTS

| | | | | | |
|---|---|---|---|---|---|
| 341,414 | A | * | 5/1886 | Fowler | 470/122 |
| 701,178 | A | * | 5/1902 | Dussault | 470/122 |
| 2,473,543 | A | * | 6/1949 | Randolph | 219/103 |
| 2,740,136 | A | * | 4/1956 | Chiaberta et al. | 470/10 |
| 2,820,972 | A | * | 1/1958 | Ptak | 470/8 |
| 3,112,150 | A | | 11/1963 | Hammell | 439/882 |
| 3,118,740 | A | | 1/1964 | Cornell, Jr. | 428/572 |
| 3,127,625 | A | * | 4/1964 | Ruminsky | 470/8 |
| 3,284,825 | A | * | 11/1966 | Brauchla | 470/11 |
| 3,354,854 | A | | 11/1967 | Kosha | 29/874 |
| 4,018,177 | A | | 4/1977 | McKee et al. | 29/874 |
| 4,028,925 | A | * | 6/1977 | Mainiero | 72/294 |
| 4,443,937 | A | | 4/1984 | Dominici et al. | 29/874 |
| 4,739,551 | A | | 4/1988 | Bowsky et al. | 29/882 |
| 4,769,907 | A | | 9/1988 | Sebastien | 29/874 |

* cited by examiner

*Primary Examiner* — Edward Tolan

(74) *Attorney, Agent, or Firm* — Wiggin and Dana LLP; Gregory S. Rosenblatt

(57) ABSTRACT

A method to make a flanged pin is described. The method includes feeding wire through a forming die whereby the wire is deformed to create a straight pin. The straight pin is then fed from the forming die to a heading die having a pre-formed cavity where a first portion of the straight pin is located in the forming die and a second portion of the straight pin is located in the heading die. A portion of the pin is secured in the forming and heading die, having a portion of the straight pin disposed in a gap defined by a space between the heading die and the forming die. As the die gap is closed, the portion of the straight pin is displaced into a pre-formed cavity thereby creating a flange.

18 Claims, 6 Drawing Sheets

METHOD TO CONTINUOUSLY FORM SURFACE MOUNT FLANGED PINS

BACKGROUND (1) Field

The present disclosure generally relates to surface mount flanged pins and particularly, is directed to a method of manufacturing flanged pins in an end to end format.

(2) Description of the Related Art

Generally, surface mount pins are inserted into a work piece to act as an electrical interface between the work piece and conventional connector wiring devices. Typically, the pins are made in an end-to-end format, where coiled wire is straightened and formed into the specified pin geometry. The pin can then be separated using a pin insertion machine, which separates one pin from the end-to-end chain. The separated pin can then be positioned over the work piece and inserted by pushing a preset distance on the tip of the pin. Variables such as the speed and inertia of the insertion process, the actual size of the hole in the work piece, and the relative ability of the pin geometry to resist deflection when subjected to the insertion forces, can cause the insertion depth to vary and deformation of the pin shaft to occur. The method of making a pin for a circuit board is described in U.S. Pat. No. 4,769,907, to Sebastien, and is hereby incorporated by reference in its entirety.

In most situations the pin and work piece require a soldered connection. This is typically achieved by applying a solder paste to the conductive surface around the hole in the work piece as well as directly over the hole in the work piece. The pin is then inserted through the solder paste and into the hole in the work piece. Some of the solder paste adheres to the pin and subsequently forms a solder fillet between the pin and the conductive surface around the pin during the reflow process. However, some solder paste is dispersed by the pin as it is inserted, resulting in waste and the possibility of contaminating the work piece with free conductive material.

The use of this type of pin in a work piece has many drawbacks. Several factors, such as the force required for the insertion and the strength of the pin can lead to inserting the pin too deep or not deep enough, or, breaking or bending of the pin. In addition, the use of large amounts of solder can lead to waste and contamination.

Rather than a straight pin, as discussed above, a flanged pin can be used in a work piece. A flanged pin has a rim (i.e. a flange) around a portion of the pin. The flange provides a rigid surface for pushing the pin into the work piece and thereby eliminates the potential for distorting the pin shaft. The flange also defines a precise seating plane by preventing the pin from being inserted beyond the specified depth. Additionally, solder can be applied to the conductive material around the hole in the work piece directly beneath the flanged portion of the pin to create a 360 degree, high strength, low electrical resistance, no waste joint after the reflow process.

Flanged pins are currently more difficult and expensive to manufacture than straight pins. Typically, flanged pins today utilize turret fabrication using lathe equipment. This is a very costly manufacturing method and requires slow bowl feeding insertion equipment. What is needed is an effective way to produce a continuous reel of flanged pins.

BRIEF SUMMARY

One aspect of the present disclosure is a method to make a flanged pin. The method includes feeding wire through a forming die having notches; deforming the wire into a plurality of straight pins; partially advancing the straight pins from the forming die to a heading die having a pre-formed cavity, whereby a first portion of the straight pin is located in the forming die and a second portion of the straight pin is located in the heading die. The method further includes securing the first portion of the straight pin in the forming die and securing the second portion of the straight pin in the heading die, whereby a third portion of the straight pin is disposed in a gap defined by a space between the heading die and the forming die and then closing the gap causing the third portion of the straight pin to be displaced in the pre-formed cavity forming a flange around the straight pin and forming a flanged pin. Next, opening the forming die and the heading die thereby releasing the flanged pin; and repeating the method.

Another aspect of the disclosed subject matter is an apparatus for manufacturing flanged pins. The apparatus includes a forming die, a notch, a heading die and a gap defined by a space between the forming die and the heading die. The forming die having a top portion and a bottom portion; and an open and closed position, where when the forming die is in the open position a wire can be fed into the forming die thereby defining a straight pin. The heading die having a top portion and a bottom portion parallel to one another, the heading die having a pre-formed cavity, a sliding portion and an open and closed position.

BRIEF DESCRIPTION OF THE DRAWINGS

For the purpose of illustrating the disclosed subject matter, the drawings show an embodiment of the disclosure. However, it should be understood that the present disclosure is not limited to the precise arrangements and instrumentalities shown in the drawings, wherein.

DETAILED DESCRIPTION

Figure 1:
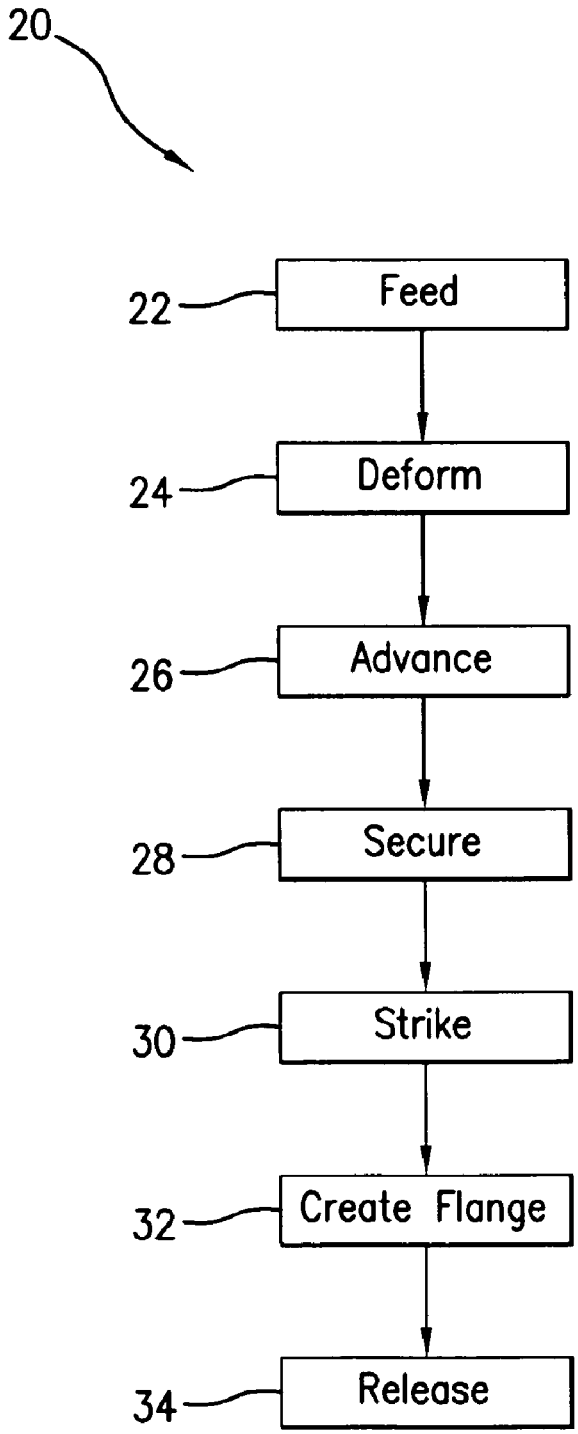
FIG. 1 is a flow diagram of a method according to embodiments of the disclosed subject matter.

Referring now to the drawings in which like reference numerals indicate like parts, and in particular, to FIG. 1, one aspect of the disclosed subject matter is a method 20 to make a flanged pin. At 22, the method includes feeding wire through a forming die. Typically, the wire is a coiled, pre-plated metal commonly used in the manufacturing of electrical pins such as a stainless steel or a copper core wire with a stainless steel jacket. However, it is contemplated that a hollow tube could be used in the process as well. The wire can be flattened before entering the forming die. At 24, the wire is deformed into straight pins in a forming die. A straight pin is a segment of wiring having a substantially uniform diameter except for the tips, which may be tapered. The forming die has a plurality of notches spaced at prescribed distances, which cause breaking points in the wire. Typically, the notches get progressively larger, which in turn makes the breaking points in the pin progressively deeper. As the wire progresses through the forming die, the wire oscillates about 90 degrees, causing the wire to become gradually more defined until there is a breaking point that is approximately 50 percent of the thickness of the wire. This creates a straight pin in an end to end format.

A typical straight pin used in this type of circuit would be about 0.012 inches to about 0.090 inches in diameter and from about 0.100 inches to about 2.000 inches long. The wire is not completely severed, only partially severed, typically about 50%, in order to allow the wire to continue through the process in an end-to-end format. The length of the straight pin is predetermined by the forming die and can be changed or adjusted to make any size straight pin desired by changing the forming die.

At 26, the straight pins are fed from the forming die to a heading die having a sliding portion and a pre-formed cavity. A gap is defined by the end of the forming die and the beginning of the heading die. The size of the gap can vary, but must be smaller than the length of one straight pin in order for each side of the straight pin to be secured. The forming die and the heading die are spaced apart a distance shorter than the length of one straight pin thereby creating a gap. The size of the gap is effective such that a first portion of a straight pin can be secured by the forming die, and a second portion of the straight pin can be secured by the heading die. With both the forming die and the heading die in the open position a straight pin is fed from the forming die to the heading die.

At 28, the forming die and the heading die are closed at a point where a first portion of the straight pin is located in the forming die and a second portion of the straight pin is located in the heading die. By closing the forming die and the heading die, the straight pin is secured. With a first portion of the straight pin in the forming die, and a second portion of the straight pin in the heading die, a third portion of the straight pin remains in the gap created by the space between the forming die and the heading die.

At 30, the heading die is mechanically struck causing the sliding portion to effectively close the gap between the forming die and the heading die. The mechanical striking can be accomplished by any known device or method in the art such as mechanical, hydraulic or pneumatic actuation. At 32, as the gap closes, the third portion of the straight pin is displaced into the pre-formed cavity of the heading die. This consequently creates a flange around the straight pin, thereby transforming the straight pin into a flanged pin.

The forming die and the heading die are then opened and, at 34, the flanged pin is released. The reel of wire is advanced the predetermined length of one straight pin and the process can be completed until the entire reel of wire is made into flanged pins. The flanged pins can then be wound fed onto a new reel of finished flanged pins.

Figure 2:
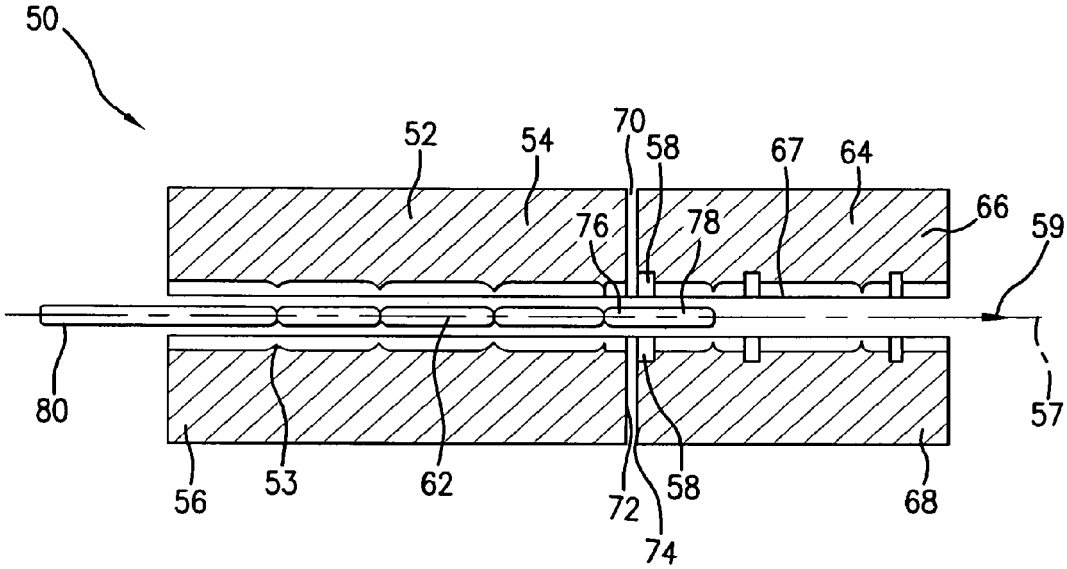
FIG. 2 is an isometric view of an apparatus in the open position according to the disclosed subject matter.
Figure 3:
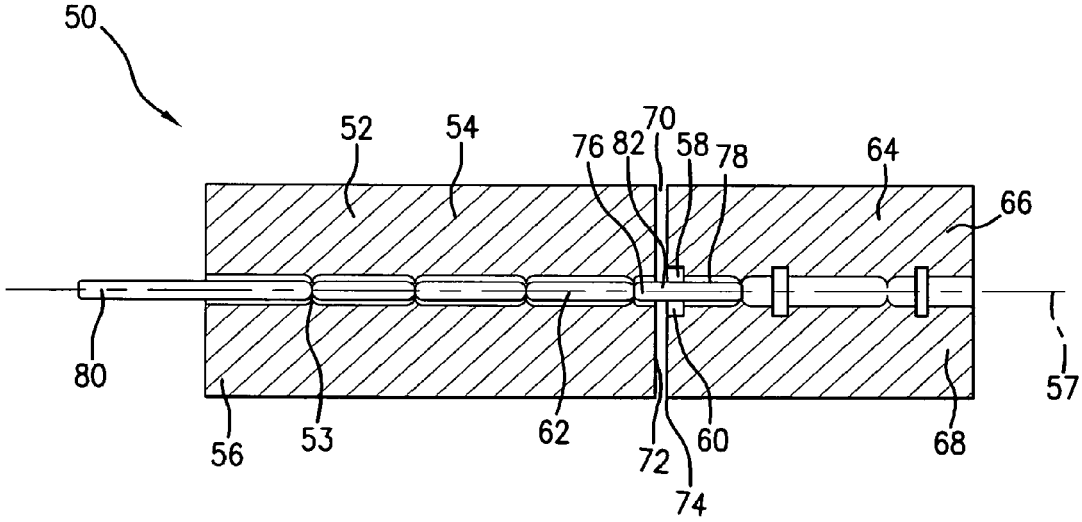
FIG. 3 is an isometric view of an apparatus in the closed position according to the disclosed subject matter.
Figure 4:
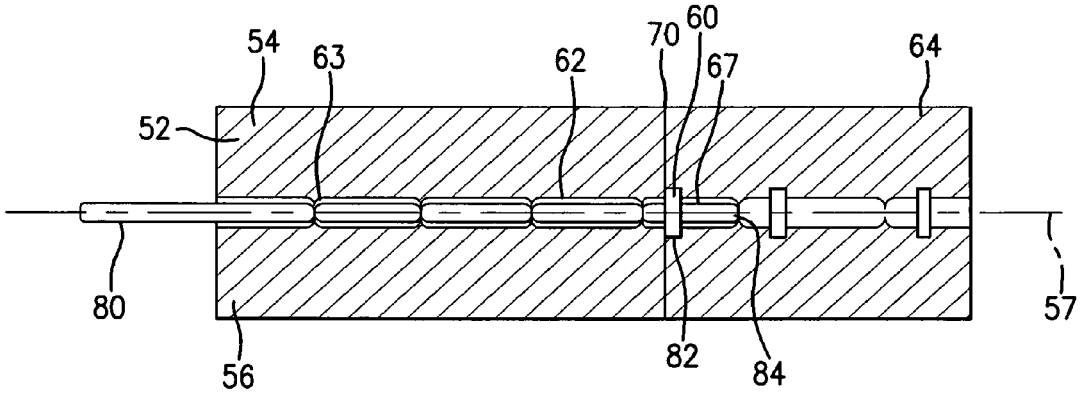
FIG. 4 is an isometric view of an apparatus in the closed position according to the disclosed subject matter.
Figure 5:
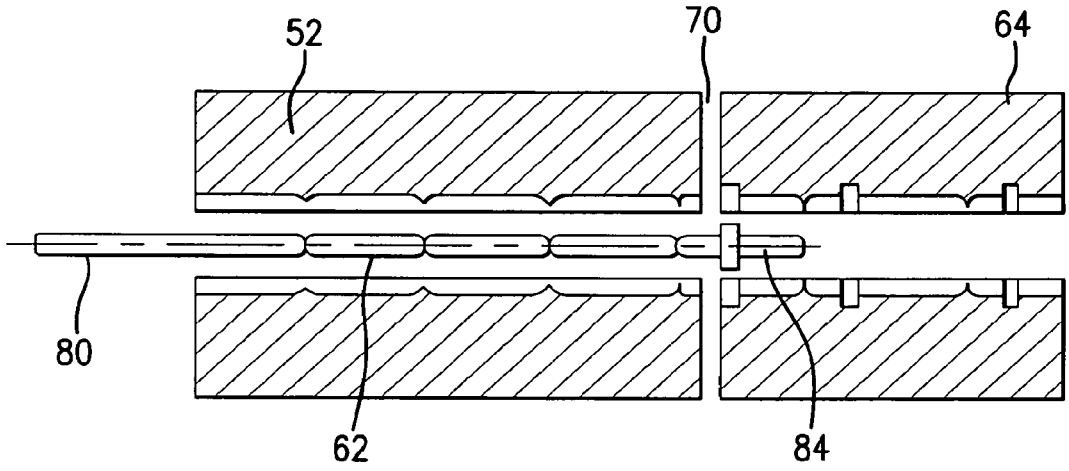
FIG. 5 is an isometric view of an apparatus in the open position according to the disclosed subject matter.

Referring now to FIG. 2, in one embodiment of the disclosed subject matter, an apparatus for carrying out a method to make a flanged pin is shown. Apparatus 50 includes a forming die 52, and a heading die 64. Forming die 52 can be similar to those known in the art effective for creating straight pins. Forming die 52 has a top portion 54 and a bottom portion 56. Forming die 52 can be in the open position as shown in FIGS. 2 and 5, or in the closed position as shown in FIGS. 3 and 4.

Top portion 54 and bottom portion 56 of forming die 52 are symmetrical to one another and are oriented in a parallel position along longitudinal axis 57. Forming die 52 has a plurality of notches 53 spaced evenly apart, situated on top portion 54 and bottom portion 56. Notches 53 get progressively deeper along longitudinal axis 57 as moving in the direction of the work flow as indicated by arrow head 59. Forming die 52 also has a mechanism to cause a wire 80 to oscillate approximately 90 degrees in the forming die. An exemplary oscillation mechanism is a rotation device. The oscillation causes wire 80 to be partially severed by notches 53. The partial severing continues until it reaches a breaking point depth of about 50% that enable singulating when the pin is to be used, thereby creating a straight pin 62.

Heading die 64 also has a top portion 66 and a bottom portion 68, a position and in parallel along longitudinal axis 57. Similarly to forming die 52, heading die 64 can be in the open or closed position. As shown in FIG. 2, both top portion 66 and bottom portion 68 have notches 58. Notches 58 can be of any size and shape. Notches 58 are located in top portion 66 and bottom portion 68 such that when the top portion and the bottom portion are in the closed position, the notches define a pre-formed cavity 60, as shown in FIGS. 3 and 4. The predetermined size and shape of pre-formed cavity 60 determines the size and shape of the flange to be created on straight pin 62. Heading die 64 also has a sliding portion 67 that slides horizontally along longitudinal axis 57.

When heading die 64 is in the open position straight pins 62 can be fed into it from forming die 52. When heading die 64 is in the closed position, straight pin 62 can be secured.

Forming die 52 and heading die 64 are situated on the same plane, such that straight pin 62 is not deformed during subsequent operations. Forming die 52 and heading die 64 define a gap 70 between them. Gap 70 is defined by a first edge 72 of forming die 52 and a second edge 74 of heading die 64. The size of gap 70 is directly in proportion with the pre-determined size of straight pin 62. Gap 70 must be sized to effectively hold a first portion 76 of straight pin 62 and a second portion 78 of the straight pin.

For example, when forming die 52 and heading die 64 are in the open position, wire 80 can be fed into the dies. As wire 80 travels through forming die 52 straight pins 62 are created by the oscillation of the forming die and the notches creating a partial severing of the wire. The process of creating straight pins from a reel of wire is typically used in the industry. As straight pins 62 are created, they travel from forming die 52 to heading die 64.

As each straight pin 62 approaches gap 70, apparatus 50 pauses, and forming die 52 and heading die 64 close, as shown in FIG. 3. Referring now specifically to FIG. 3, when forming die 52 and heading die 64 are in the closed position, straight pin 62 is secured. First portion 76 of straight pin 62 is secured in forming die 52 and second portion 78 of the straight pin is secured in heading die 64. A third portion 82 of straight pin 62 is located in gap 70.

As the process continues, as shown in FIG. 4, gap 70 closes. This can be accomplished by a mechanical strike or similar force to sliding portion 67 of heading die 64. The closing of gap 70 causes third portion 82 of straight pin 62 to be displaced into pre-formed cavity 60. As straight pin 62 is displaced, a flange is formed thereby creating a flanged pin 84.

Figure 6:
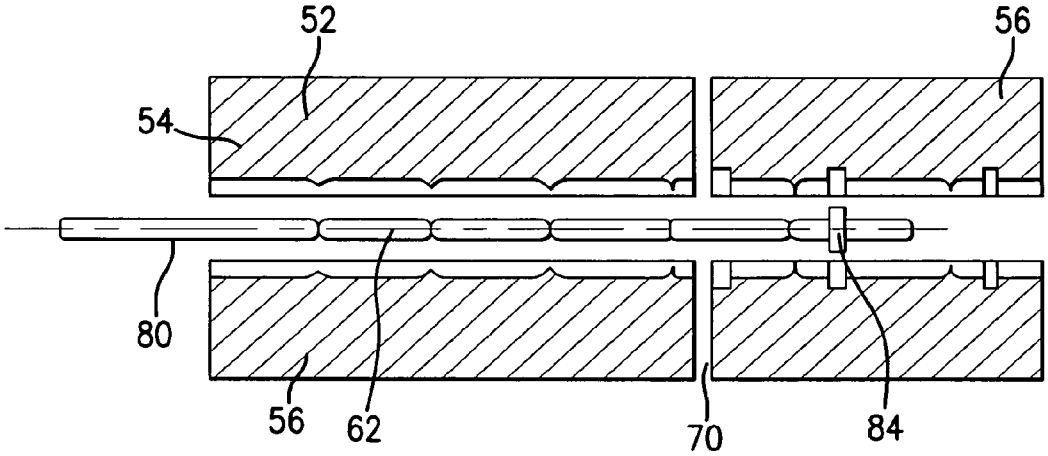
FIG. 6 is an isometric view of an apparatus in the open position according to the disclosed subject matter.

Forming die 52 and heading die 64 can then be opened as shown in FIG. 5, to release flanged pin 84 and the entire process can be repeated by advancing wire 80 the length of one straight pin 62 as shown in FIG. 6.

When the flanged pin is to be used, it is first singulated from the reel. The flanged pin then is inserted into a circuit board by pushing the pin from the top of the flange into the board until the bottom of the flange contacts the circuit board. This controls the depth of insertion and eliminates outside variables.

Typically, a straight pin is pushed from the end and can lead to bending or breaking of the shaft. By pushing the pin in by the flange, there is much more control and less risk of damaging the pin.

In addition, by using flanged pin in a circuit board, the amount of solder typically required to complete the connection is drastically reduced. The solder can be applied only to the conductive surface around the hole. A solder ring can be printed on to the board. As the pin is inserted, the flanged portion contacts the solder creating a large surface area to form a circumferential solder fillet during a subsequent reflow process. Unlike previous methods, where the hole and surrounding proximity is covered when the pin is inserted it forces the solder to disperse, there is no solder waste or dispersion and a better electrical and mechanical connection is achieved.

In addition, the current method produces a high speed and precision component at the low progressive tool price.

Although the disclosure has been described and illustrated with respect to exemplary embodiments thereof, it should be understood by those skilled in the art that the foregoing and various other changes, omissions and additions may be made therein and thereto, without parting from the spirit and scope of the present disclosure. Accordingly, other embodiments are within the scope of the following claims.

What is claimed is:

1. A method to make a chain of flanged pins in an end to end format, comprising the steps of:

a. feeding wire through a forming die;

b. partially severing said wire into a plurality of straight pins separated by breaking points;

c. partially advancing each straight pin from said forming die to a heading die having a pre-formed cavity whereby a first portion of said straight pin is located in said forming die and a second portion of said straight pin is located in said heading die;

d. securing said first portion of said straight pin in said forming die and securing said second portion of said straight pin in said heading die, whereby a third portion of said straight pin is disposed in a gap defined by a space between said heading die and said forming die;

e. closing said gap by horizontally sliding said heading die along a longitudinal axis of said straight pin, thereby causing said third portion of said straight pin to be displaced in said pre-formed cavity forming a flange around said straight pin and forming a flanged pin having a substantially uniform diameter on either side of said flange;

f. opening said forming die and said heading die thereby releasing said flanged pin; and g. repeating steps c through f with a next straight pin of said plurality of straight pins.

2. The method of making a flanged pin of claim 1, further comprising advancing said wire though said forming die a length of one straight pin.

3. The method of making a flanged pin of claim 2, wherein prior to said feeding step a, said wire is selected to be a coiled, pre-plated metal wire.

4. The method of making a flanged pin of claim 3, wherein said wire is uncoiled prior to said feeding step a.

5. The method of making a flanged pin of claim 4, wherein closing said gap is caused by mechanically striking said heading die.

6. The method of making a flanged pin of claim 5, further including winding said flanged pins onto a reel.

7. The method of claim 2 wherein said forming die is formed with a plurality of notches effective to progressively deepen said breaking point.

8. The method of claim 7 including oscillating said wire as said wire progresses through said forming die.

9. The method of claim 8 including oscillating said wire about 90 degrees.

10. The method of claim 2 including oscillating said wire as said wire progresses through said forming die.

11. The method of claim 10 including oscillating said wire about 90 degrees.

12. An apparatus for manufacturing a plurality of flanged pins in an end to end format comprising:

a forming die having a top portion and a bottom portion, said forming die having an open position and closed position, wherein when said forming die is in the open position a wire can be fed into said forming die thereby defining a straight pin;

notches orientated in said top portion and said bottom portion of said forming die that get progressively deeper, effective to partially sever said wire when said forming die is in said closed position thereby creating a plurality of straight pins in an end to end format; and a heading die separated from said forming die by a gap when said heading die is in an open position, said heading die having a top portion and a bottom portion parallel to one another, said heading die having a pre-formed cavity and a sliding portion, wherein said heading die reciprocates between said open position and closed position by horizontally sliding along a longitudinal axis of said plurality of straight pins.

13. An apparatus according to claim 12, wherein said forming die includes an oscillation mechanism.

14. An apparatus according to claim 13, wherein said notches are spaced evenly apart.

15. An apparatus according to claim 14, wherein when said forming die is in the closed position, a first portion of said straight pin is secured.

16. An apparatus according to claim 15, wherein said heading die is in the closed position, a second portion of said straight pin is secured.

17. An apparatus according to claim 16, wherein said gap is closed by mechanically striking said sliding portion of said heading die.

18. An apparatus according to claim 17, wherein said wire is displaced in said pre-formed cavity; thereby creating a flanged pin.

* * * * *